US006568455B2

(12) United States Patent
Zieverink

(10) Patent No.: US 6,568,455 B2
(45) Date of Patent: May 27, 2003

(54) JEWELRY MAKING METHOD USING A RAPID PROTOTYPING MACHINE

(76) Inventor: Robert M. Zieverink, 7125 Incline Dr., Wake Forest, NC (US) 27587

( * ) Notice: Subject to any disclaimer, the term of this patent is extended or adjusted under 35 U.S.C. 154(b) by 31 days.

(21) Appl. No.: 09/832,987

(22) Filed: Apr. 10, 2001

(65) Prior Publication Data

US 2002/0144515 A1 Oct. 10, 2002

(51) Int. Cl.[7] ..... B22C 7/02

(52) U.S. Cl. ..... 164/4.1; 164/35; 164/45; 164/516; 700/118

(58) Field of Search ..... 164/4.1, 35, 45, 164/516; 29/896.4; 63/23; 700/118

(56) References Cited

U.S. PATENT DOCUMENTS 4,508,156 A * 4/1985 Banks et al. ..... 164/35
4,518,288 A * 5/1985 Cilindro ..... 409/219
4,993,472 A * 2/1991 Culver ..... 164/35
5,365,996 A * 11/1994 Crook ..... 164/45
5,432,703 A * 7/1995 Clynch et al. ..... 364/474.05
5,594,989 A * 1/1997 Greve ..... 29/896.4
5,762,125 A * 6/1998 Mastrorio ..... 164/4.1
5,868,194 A * 2/1999 Horwood ..... 164/456
5,896,663 A * 4/1999 Greve ..... 29/896.41
6,003,228 A * 12/1999 Riggio ..... 29/896.41
6,435,255 B1 * 8/2002 Kaladjian ..... 164/35
6,446,697 B1 * 9/2002 Shaikh et al. ..... 164/4.1
6,460,594 B1 * 10/2002 Lam ..... 164/35

* cited by examiner

*Primary Examiner*—M. Alexandra Elve
*Assistant Examiner*—Kevin P. Kerns
(74) *Attorney, Agent, or Firm*—Jeffrey K. Seto; Seto Patents

(57) ABSTRACT

A method for making personalized jewelry and the personalized product of this jewelry making method. The method includes digitally capturing the image of a person or other object. The image is saved as a digital profile and processed to create a numerical profile. The numerical profile includes prototyping machine instructions that cause a prototyping machine to produce a wax block that contains a replica of the scanned object. The wax block is placed in a warm bath so that an outer wax melts away and an inner wax of the scanned object remains. The wax replica is then used in a "lost wax process" to make a mold of the wax replica. The mold is then used in a casting process wherein the mold is injected with precious, semi-precious, or base metals to make a cast of the object. The finished product is a replica of the object with exacting features such as nose, eyes, ears, etc. Any cavity or flat surface can be colored with epoxies, resins, enamels, or decorated further to give color contrast. Partial and segregated replication can also take place. The present process truly creates "personalized" charms and pieces of jewelry.

8 Claims, 6 Drawing Sheets

JEWELRY MAKING METHOD USING A RAPID PROTOTYPING MACHINE

BACKGROUND OF THE INVENTION

The present invention relates generally to the field of jewelry manufacturing and more specifically to a machine and method for scanning an object and manufacturing a miniaturized replica of the object in a precious metal such as gold and silver.

After the 1920's, machining tools became specialized in their applications. From about 1930 to 1950 more powerful and rigid machine tools were built to effectively utilize the improved cutting materials that had become available. These specialized machine tools made it possible to manufacture standardized products economically. The machines, however, lacked flexibility and they were not adaptable to a variety of products or to variations in manufacturing standards. As a result, in the past decades engineers have developed highly versatile and accurate machine tools that have been adapted to computer control, making possible the manufacture of products with precise details.

Jewelry holds an important place in history and continues to play an integral role in society today. The giving and receiving of precious metals, rare stones, and other forms of jewelry has been the universal sign of love, gratuity and loyalty. Rare stones such as rubies and emeralds can be cut and polished to accent the light that shines through the stones and may subsequently be mounted on a ring or worn as a pendant. Precious metals, such as gold and silver, can also be worn as rings and pendants but also have the additional characteristic of being able to be melted and poured into casts of many different shapes. These characteristics allow these metals to take on many different forms, thus giving jewelry making many more possibilities.

Casting is accomplished in two stages: first, an impression or negative mold is formed by the prototyping machine; and, second, a positive cast or reproduction is made of the original wax object from the negative impression. The term negative refers to the hollow form or mold into which the liquefied casting material is poured. The term positive means the copy or reproduction resulting from filling the negative mold with the substances selected for the specific cast, which are then allowed to harden. Plaster or clay is frequently used for the negative mold, and gold or silver for the positive or final work.

A novel way of personalizing a piece of jewelry for a parent is to make a miniaturized bust of their son or daughter. Such a trinket could be worn on a bracelet or as a pendant for a necklace. The present system provides making t h e bust hollow so that larger busts could be made of a precious metal and placed on shelves. In the present system, one of several scanning technologies is used to capture a numerical multi dimensional profile of a child, a child's head or another object. The object's image is captured through any method capable of digital capturing, such as laser based scanning, two dimensional video silhouette images or white light phase measurement, for example. The digital image is stored via a numerical coding system. The generated numerical code is used to instruct a prototyping machine in the output of layers of wax that will subsequently be used to make a piece of jewelry. The present machine will be discussed further below. Such techniques of capturing three-dimensional profiles are used in the fields of motion picture special effects and the custom fitting clothing industry. The clothing industry, for example, uses laser based scanning to measure customers and make exact custom fit clothes for the customer, from head to foot. In the present method of image capturing, a person or object is placed in a scanning booth and a three or four-dimensional numerical profile is generated. This numerical profile can contain hundreds of thousands, or more, data points, which are stored on data discs. This digital data can be processed by processing circuitry and manipulated by computer software and even provided with pre-existing three dimensional background profiles, to create a composite three-dimensional picture. The present method involves using a three-dimensional computer profile as the instructions for creating a miniaturized replica of the scanned object. The method uses a wax replica of the object to make the inside cavity of a mold. Melted gold or silver is poured or injected into the mold to make a cast of the object. The cast replica can be finished with polishing or coloring and may be worn as a piece of jewelry.

There are several ways to obtain multi-dimensional profiles of faces, animals, full bodies, flowers, or other tangible items. In the preferred embodiment, white light based scanners included in a scanning booth are used. These scanners capture hundreds of thousands of data points of the object scanned. Processing circuitry then compiles, compares, and manipulates the data to produce an extremely accurate multi-dimensional profile of the scanned product. This process is known as white light phase measurement profilometry (PMP). The PMP full body scan system is now commercially available. Another method of capturing a profile in three-dimensions is laser based scanning whereby one or more lasers are used to acquire a full three-dimensional image of the scanned object. A third way of capturing an object's image is two dimensional video silhouette imaging. These digital capturing methods produce numerical locations for hundreds of thousands of measurement points, which may correlate to a full three-dimensional human head, for example.

In the preferred embodiment, a scanning booth is used to scan and capture the multi-dimensional numerical profile of the subject. The numerical profile is sent to a computer where it is manipulated as to distortion, size, background, etc. The computer generates a numerical code that comprises instructions for a rapid prototyping machine, such as the Sanders prototyping machine. This numerical code is sent to the prototyping machine and instructs the machine in the output of layers of wax. The first layer of wax is placed on a worktable and the second layer of wax is laid across the first layer. This layering process continues with the next layer being placed upon the last layer until a wax block is created. Each layer in the block may only be $^{3}/_{1000}$ of an inch (in) thick. The block of wax contains two waxes each of which melts at a different temperature. When the layering procedure is completed, the first wax is a replica of the scanned object and the second wax surrounds the scanned object and defines the outer boundaries of the block. In the preferred embodiment, green wax is used to replicate the scanned object and red wax is the complementary wax used in the block of wax i.e., everything in the block that is not the scanned object. The red wax is has a lower melting temperature than the green wax. Therefore, when the entire block of wax is put into water that is heated to the specified temperature, the outer red wax will melt away and what remains is the green wax which is the replica of the scanned object. This green wax is then used in what is called the "lost wax process" whereby the wax is surrounded by investment that becomes a mold of the replica. The green wax and investment are heated and the green wax burns out and the cavity it creates is used to make cast replicas in precious, semi-precious, or base metals. The resulting mold is used in the casting process using any of the well known casting techniques.

When the object is a person, the finished product can be a full bust with exacting features such as nose, eyes, ears, etc. Any cavity or flat surfaces created by the present method can be colored with epoxies, resins, enamels, or decorated further to give color contrast. Partial and segregated reproduction can also take place, for example a miniature full body of a boy can be made from separately produced parts. A wax block of the legs could be made and cast into platinum, a wax block of the arms can be made and cast into silver, the head could be made out of gold and so on. The segregated pieces can be attached, by glue or soldering for example, to produce the replica.

SUMMARY OF THE INVENTION

A method for making a piece of jewelry involving a scanning booth, a rapid prototyping machine that is used to make a mold and a casting process that uses the mold to produces the piece of jewelry, in one embodiment. The scanning booth scans a person or other object and creates a digital profile of the person or object. The digital profile is processed into a numerical profile that is used to control the operation of the rapid prototyping machine in the production of a block of wax. The wax is used in a "lost wax process" to make a mold of the scanned person or object. The mold is then used in a casting process to produce metal replicas of the scanned object. The finished product is a replica of the object with exacting features such as nose, eyes, ears, etc. Any cavity or flat surface of the metal can be colored with epoxies, resins, enamels, or decorated further to give color contrast. Partial and segregated machining can also take place. The present method truly provides "personalized" charms and pieces of jewelry.

BRIEF DESCRIPTION OF THE DRAWINGS

The invention of the present application will now be described in more detail with reference to the accompanying drawings, given only by way of example, in which.

DETAILED DESCRIPTION OF THE INVENTION

Figure 1:
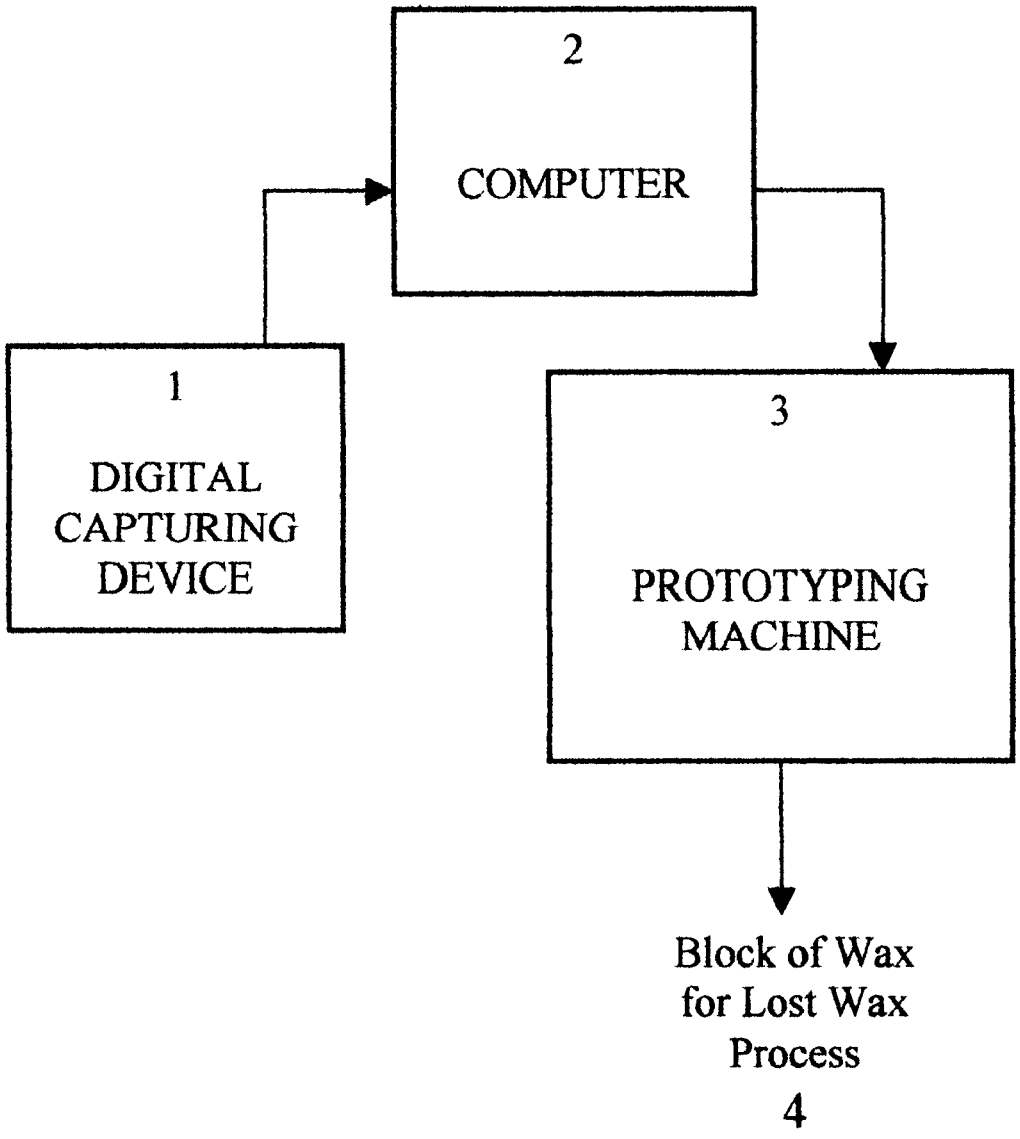
FIG. 1 is a schematic drawing of the first part of the present method.

Referring to FIG. 1, the first three components of the present jewelry making system are schematically shown. Digital Capturing Device 1 is used to capture a three dimensional or four dimensional image of an object, that may be a person. In the preferred embodiment capturing device 1 is a white light based scanner that captures hundreds of thousands of data points from the scanned person or object. The white light based scanner then compiles, compares, and manipulates the image data to produce an extremely accurate three-dimensional digital profile of the scanned object. This scanning system, also known as white light phase measurement profilometry (PMP) can produce a full body digital profile of a scanned person and such systems are now commercially available. In an alternative method the device for capturing a three dimensional digital profile is a laser based scanning system, wherein one or more lasers are used to acquire a full three-dimensional image of a scanned object. In a third embodiment, the digital capturing device 1 is a two-dimensional video silhouette imaging system.

No matter what embodiment is used, digital capturing device 1 produces a multi-dimensional digital profile of the scanned object, or person, that can be stored and electronically transferred. Computer 2 receives the multi-dimensional digital profile from capturing device 1 and processes the data to produce a numerical profile of the scanned object or person. This numerical profile of the object or person is then stored in the computers memory, in one or more memory chips or storage disks. Of course, since the profile is in a digital format, the profile can be electronically transmitted to any number of other locations. The numerical profile produced by computer 2 comprises a series of instructions that are used to control prototyping machine 3. Machine 3 includes two different colored waxes that it selectively outputs in very thin layers upon a worktable. A single layer of wax is typically about $3/1{,}000$ inch and when machine 3 has completed outputting all of layers required by the numerical profile, the result is a block of wax 4 containing the two different colored waxes. In the preferred embodiment, green wax is used to replicate the scanned object; green wax is the positive form. Red wax is used as the temporary negative form or impression and constitutes the remaining portion of the block of wax 4. Prototyping machine 3 replicates the object by building it with the thin layers. During a single pass, green wax is output where the object would be and red wax is output everywhere else. The red wax provides a structural border for the replicated object in green wax.

Figure 2:
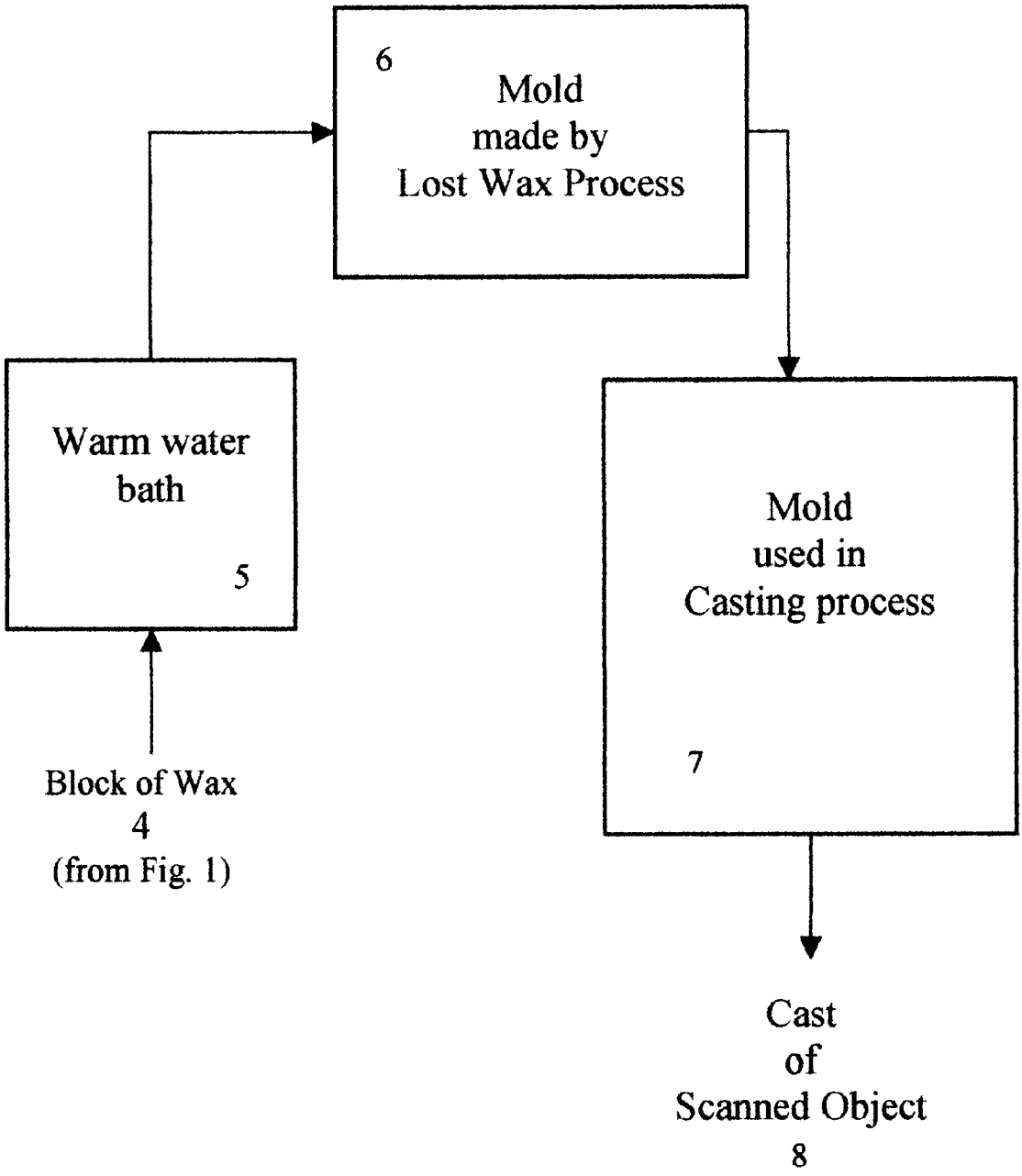
FIG. 2 is a schematic drawing of the second part of the present method.

In FIG. 2, the block of wax 4 is taken from prototyping machine 3 and place in a water bath 5. The temperature of the water in bath 5 is set so that it is higher than the melting temperature of the red wax but, lower than the melting temperature of the green wax. After being place in water bath 5, the red wax, the negative impression, melts away and the green wax, the replica of the object, remains. The wax replica is then used to make a mold via the lost wax process 6. In the typical lost wax process a material such as plaster or clay is formed around the replica to make a mold. In the preferred embodiment, jeweler's burnout investment is used to make the mold of the replica. The green wax replica and investment that surrounds it are heated and the wax bums away leaving a cavity in the shape of the scanned object. This mold is then used in a typical casting process 7 wherein melted gold, or other metal, is poured into the mold and allowed to cool. After cooling, the mold is opened and the cast 8 or replica of the scanned object is removed from the mold. Cast can be made to any size and further enhancing of the cast can take place if desired. The gold replica 8 can be polished, milled and/or colored.

The three components of FIG. 1 have been shown as separate modules that are electrically connected to each other. However in alternative physical embodiments, the system may have two or more of the separate modules combined into an integrated unit. In all embodiments, the system provides a user interface, such as a keyboard and display unit within computer 2, for input by the operator/user.

Figure 3:
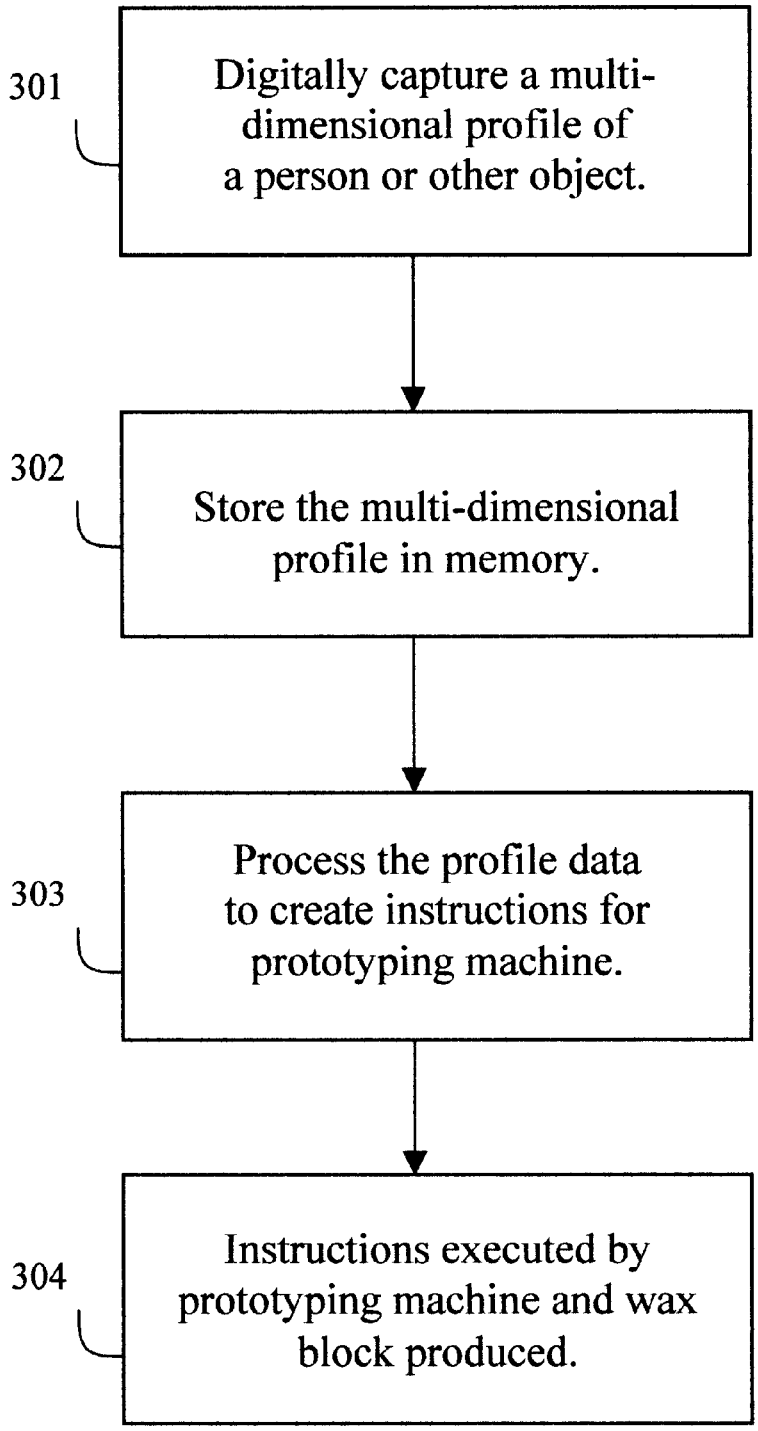
FIG. 3 is a flow chart of the first part of the present method.
Figure 4:
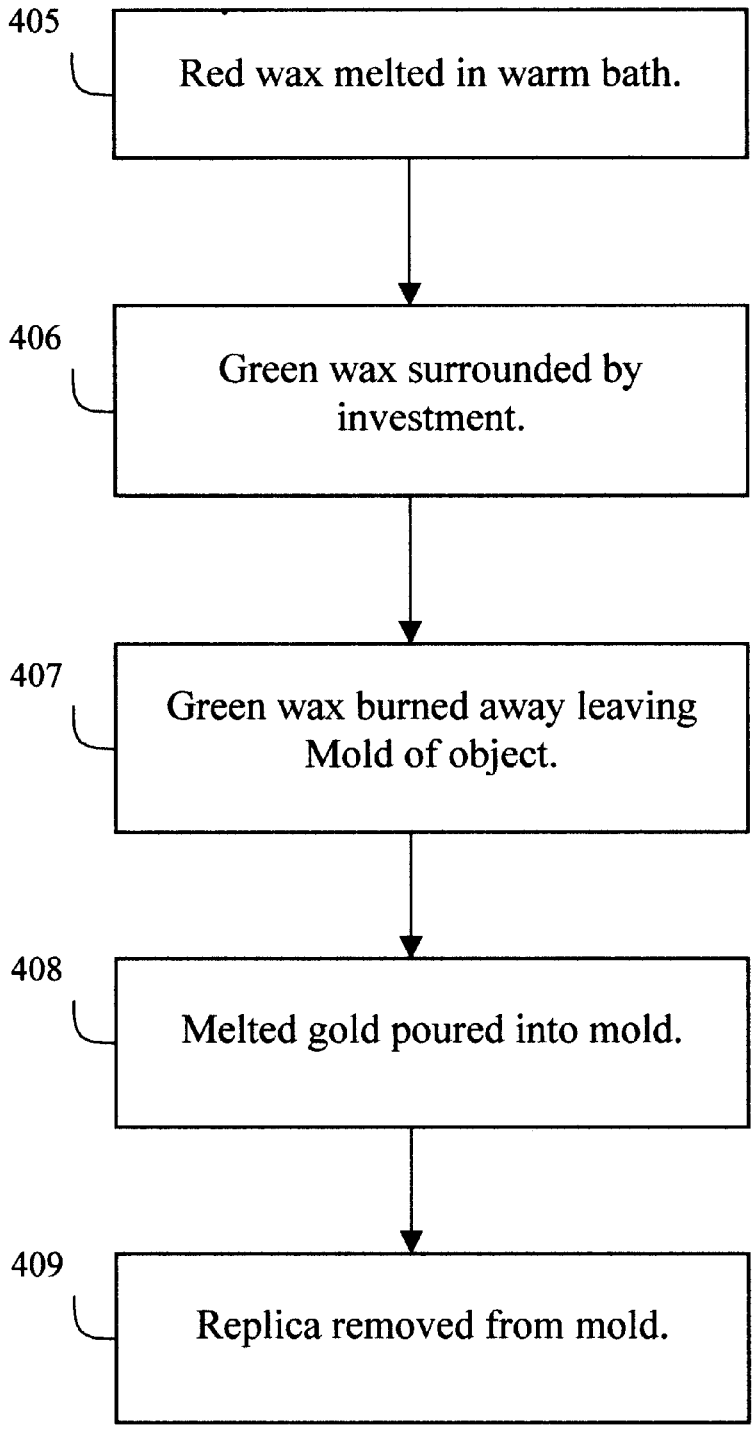
FIG. 4 is a flow chart of the second part of the present method.

FIGS. 3 and 4 show a flow chart of the major steps in the present method of making jewelry. Referring to FIG. 3, in step 301 a person or object is scanned via one of the above mentioned scanning systems. The resulting data profile may easily contain hundreds of thousands of data points, which are the digital representation of the multi-dimensional object. In step 302, the captured digital profile is stored in a memory of a computer. In step 303, the captured data is processed by processing circuitry within the computer to create instructions, or a numerical profile, for a prototyping machine. Image conversion software within the computer controls the processing of the data and also allows for manipulation of the scanned images. The conversion software allows the user to control the size, distortion, and duplication of the object, or objects. Such manipulation of the numerical file allows for increased customization of the finished piece of jewelry. For exemplary purposes only, an apple could be scanned to produce a four dimensional numerical code that contains data representing the apples top, bottom, and four rounded sides. In the preferred embodiment computer 2 includes a monitor and the apple's image is viewed on computer 2 just as a person could view a real apple in the produce section of a grocery store before choosing to buy it. Further, the software of computer 2 allows duplication of the apple so for example, the user could place three apples set one upon another. The present conversion software produces numerical codes based on location, position, size, and distortion of the apples with a set of numerical instructions.

In step 304, the instructions created in step 303 are executed by the prototyping machine. The prototyping machine replicates the object by "building" it with thin layers of wax. During a single pass of the machine, green wax is output where the object would be and red wax is output everywhere else in what will be a block of wax. The red wax provides a structural border for the replicated object. In step 405 of FIG. 4, the block of green and red wax is placed in a temperature controlled bath so that the red outer wax melts away. The green wax, which has a higher melting temperature, that remains is a replica of the scanned object. In step 406, the green wax is surrounded by jeweler's burnout investment so that the investment becomes a mold of the green wax replica. In step 407, the investment and green wax are heated and the wax burns away. The jeweler's burnout investment may now be used as a mold of the scanned object. In step 408, a precious metal such as gold is melted and poured into the mold in the classic casting process. After cooling, the gold replica is removed from the mold in step 409. The gold replica can be further enhanced by polishing and coloring.

Figure 5:
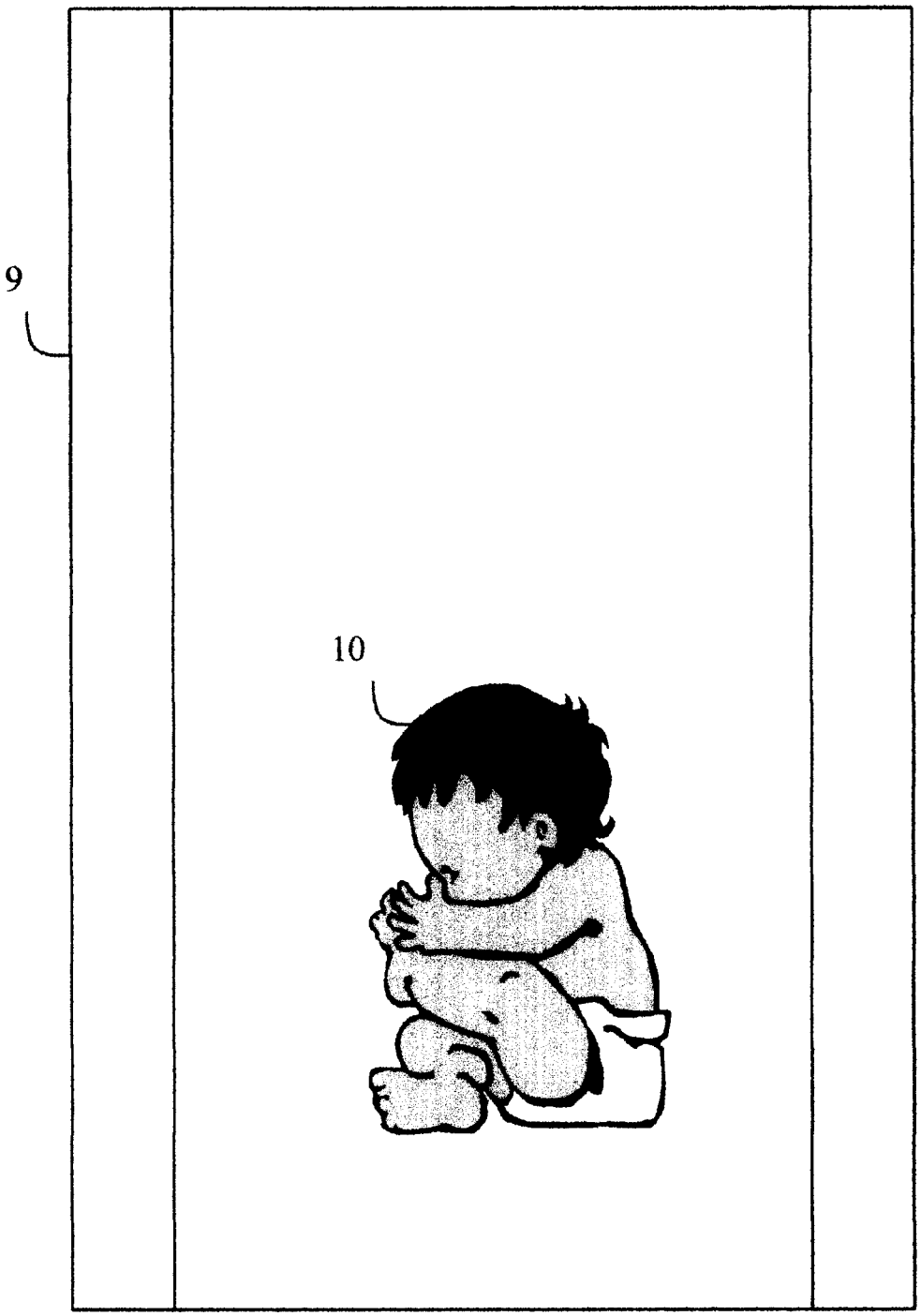
FIG. 5 is an illustration of an object being scanned.

FIG. 5 illustrates an example wherein a baby 10 has been placed in scanning booth 9. Without baby 10 even knowing it, the baby's image is scanned and a digital profile created. The digital profile is subsequently processed to create rapid prototyping machine instructions.

Figure 6:
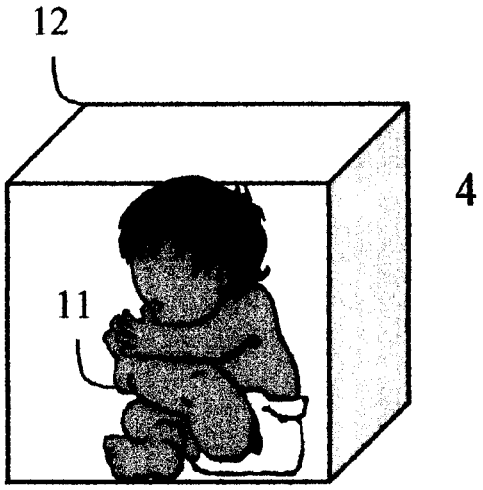
FIG. 6 is an illustration of the block of wax produced by the present prototyping machine; and, FIG. 7 is an illustration of a resulting piece of jewelry using the present method.

FIG. 6 further illustrates the example of FIG. 5 wherein after executing the prototyping machine instructions a wax block 4 is created containing two different colored waxes. In a true example, the wax replica of the baby 11 is made of green wax. The remaining wax 12 in the block 4 is red wax. After the red wax 12 is melted away, a mold is made of the baby by using the green wax replica 11 in the lost wax process. The mold is then used in a casting process.

Figure 7:
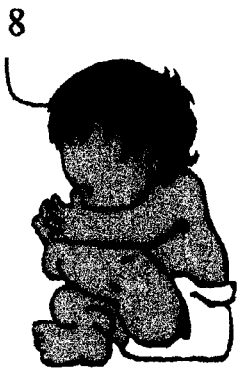

FIG. 7 illustrates a cast replica 8 of the baby 10. Replica 8 was cast by using the mold that was produced in the above lost wax process. The cast replica 8 can be made of any precious metal and to practically any size. Replica 8 has been colored to enhance replication and can be made into a charm, pendant or other piece of jewelry.

The foregoing description of the specific embodiments will so fully reveal the general nature of the invention that others can, by applying current knowledge, readily modify and/or adapt for various applications such specific embodiments without departing from the generic concept. For example, more than one numerical profile may be executed by the prototyping machine at the same time, thereby producing more than one block of wax on the worktable. Further, the wax replica of the scanned object may be made hollow which subsequently would allow the cast replica of the object to be made hollow thereby saving on the amount of precious metal required. Therefore, such adaptations and modifications should and are intended to be comprehended within the meaning and range of equivalents of the disclosed embodiments. It is to be understood that the phraseology of terminology employed herein is for the purpose of description and not of limitation.

I claim:

1. A method, for making personalized charms and other jewelry, comprising the steps of:

digitally capturing an image of a person or other object and creating a digital profile of the object or part of the object;

processing the digital profile with image software and creating a numerical profile, wherein the numerical profile comprises a set of instructions for a prototyping machine;

executing the set of instructions on the prototyping machine wherein the machine produces a block of wax containing, a first wax that is a replica of the object or part of the object, and a second wax that surrounds the replica and comprises the remaining portions of the block of wax;

melting the second wax in a process that leaves the first wax intact so that the replica of the object or part of the object remains;

surrounding the first wax with jeweler's burnout investment and heating the first wax and investment so that the first wax burns away and leaves behind a cavity in the investment that is in the shape of the replica;

using the investment as a mold in a casting process to produce a metal replica of the object or part of the object.

2. The method of claim 1, wherein the prototyping machine is a rapid prototyping machine.

3. The method of claim 1, wherein the first wax is green wax and the second wax is red wax.

4. The method of claim 1, wherein the step of melting comprises placing the block of wax in a temperature controlled water bath.

5. The method of claim 1, wherein the metal is a precious or semi-precious metal.

6. The method of claim 1, wherein the metal replica is enhanced with polishing, coloring or milling.

7. The method of claim 1, wherein the step of executing further comprises executing more than one set of instructions on the prototyping machine so that more than one block of wax is produced, wherein each block contains a different replica.

8. The method of claim 1, wherein the step of executing further comprises the prototyping machine producing a hollow replica of the object, wherein the first wax is used to produce the hollow replica of the object, and the step of surrounding further comprises injecting the hollow replica with investment prior to heating.

* * * * *